US006193082B1

(12) United States Patent
Bartle

(10) Patent No.: US 6,193,082 B1
(45) Date of Patent: Feb. 27, 2001

(54) ROLLER SKATE STORAGE DEVICE

(76) Inventor: Edwin Bartle,
Karl-Conzelmann-Strasse 17, D-72461 Albstadt (DE)

( * ) Notice: Subject to any disclaimer, the term of this patent is extended or adjusted under 35 U.S.C. 154(b) by 0 days.

(21) Appl. No.: 09/147,549

(22) PCT Filed: Jul. 17, 1997

(86) PCT No.: PCT/DE97/01512

§ 371 Date: Apr. 8, 1999

§ 102(e) Date: Apr. 8, 1999

(87) PCT Pub. No.: WO98/03235

PCT Pub. Date: Jan. 29, 1998

(30) Foreign Application Priority Data

Jul. 17, 1996 (DE) ..... 196 28 782

(51) Int. Cl.[7] ..... A47F 7/00

(52) U.S. Cl. ..... 211/85.7; 211/37; 248/346.01; D6/552

(58) Field of Search ..... 211/34, 37, 85.7; D6/552; 248/346.01; 280/825; 294/145

(56) References Cited

U.S. PATENT DOCUMENTS

| | | | | |
|---|---|---|---|---|
| D. 368,403 | * | 4/1996 | Michalk et al. | D6/552 |
| 4,126,256 | | 11/1978 | McGruder . | |
| 4,269,337 | | 5/1981 | Sobotka . | |
| 4,277,006 | | 7/1981 | Pinckard . | |
| 4,279,366 | | 7/1981 | Kessler et al. . | |
| 4,326,746 | | 4/1982 | Grihalva . | |
| 4,331,357 | | 5/1982 | Contreras . | |
| 4,394,042 | | 7/1983 | Smith . | |
| 5,120,012 | | 6/1992 | Rosenau . | |
| 5,269,580 | | 12/1993 | Hsiao . | |
| 5,547,157 | | 8/1996 | Hsiao . | |
| 5,617,958 | * | 4/1997 | Lang et al. | 211/85.7 |
| 5,617,983 | | 4/1997 | Lindauer et al. . | |
| 5,662,301 | * | 9/1997 | Fard | 211/34 X |

* cited by examiner

*Primary Examiner*—Robert W. Gibson, Jr.
(74) *Attorney, Agent, or Firm*—Jones, Tullar & Cooper, P.C.

(57) ABSTRACT

The invention concerns a device for storing roller-skates of the "inline" type with rollers which are disposed in a roller holder, which is rigid with the boot, the rollers being arranged in a line in the longitudinal direction of the boot. According to the invention, the device comprises a roller-skate parking surface which is disposed at a spacing above a device stand surface and has at least one roller holder slit.

8 Claims, 4 Drawing Sheets

ROLLER SKATE STORAGE DEVICE

FIELD OF THE INVENTION

The present invention relates to a device for storing at least one boot with only one guide track fixed on the sole, such as an inline skate or an ice skate, having a receiving body which has at least one elongated opening on its top for receiving the roller holder of an inline skate or the blade of an ice skate.

Roller skates identified as so-called "inline skates" or ice skates are equipped with a closable upper. However, in contrast to ski boots, inline skates cannot be put down at any desired location because of their roller holder on the soles. Since, because of their rollers being arranged in a line one behind the other, they have only line contact with a deposit surface, their one side must be placed against something when putting them down, wherein they often fall over. As a rule, young people do not take the trouble of placing such roller skates upright; instead, they just put them down so that, lying on their sides, for example in narrow corridors, they can constitute interfering obstacles, which can therefore be the cause of angry disputes.

A carrying bag, or case, for transporting and storing roller or ice skates is known from U.S. Pat. No. 4,126,256, wherein the latter are to be individually deposited in respectively one closeable shoe case. The shoe cases are flexibly connected with each other and can be transported, for example suspended over the shoulder.

Each shoe case contains a device of the type explained at the outset for being able to deposit a roller or ice skate in it in such a way that it is securely held in the shoe case by means of its rollers, or respectively its blade, and the shoe cases can be placed on a deposit surface. To this end, each device has a receiving body which must be specially designed for receiving a roller skate or an ice skate.

To receive an ice skate, the latter is equipped with a longitudinal groove in the transverse center, into which the blade can be inserted. The latter is supported here on the groove bottom, so that the sole of the ice skate is located at an appropriately large distance above the receiving body, and therefore the ice skate is only insufficiently laterally supported and therefore an uplight position of the boot is not assured. Aside from the fact that this construction of the receiving body is not generally suitable for positioning different types of boots with only a single guide track fixed on the sole, their arrangement in a shoe case does not allow the rapid and secure placement of such boots or their effective presentation for advertising purposes.

SUMMARY OF THE INVENTION

It is an object of the present invention to provide a device which makes the correct placement of inline skates and ice skates possible by means of one manipulation, as well as an attractive presentation of such boots for advertising purposed. In accordance with the present invention, this object is attained in that the boot can be placed with its boot sole on an upper deposit surface of a receiving body, which can be placed on a placement surface, and that in the process the roller holder, or respectively the blade can be brought into engagement, freely suspended, with an elongated opening.

Thus, the device in accordance with the present invention permits it to store an inline skate or ice skate in a secure position in an uptight manner in that its roller holder, or respectively blade is freely suspended and held in its elongated opening, and therefore the boot is supported on the sole safe from tilting.

The subject of the present invention furthermore permits, for example in the shoe trade, an advantageous presentation of all popular models of inline skates and ice skates, and for the buyer a correct deposit option for such roller skates.

The elongated opening of the receiving body can be constituted by a groove with a correspondingly great depth for the free suspended reception of a roller holder or a blade.

However, it is preferred to constitute the elongated opening by means of a receiving slit, which extends through the receiving body in height, which is of great advantage in respect to the material requirements for the receiving body.

Regarding inline skates, they are designed without heels, i.e. they are arranged on the roller holder correspondingly higher on the heel side in relation to the boot running area, than in the remaining area of the sole. Therefore, in order to assure that the rollers of the roller skate deposited on the device are located in a common horizontal plane, it is proposed to place the area portion of the roller skate deposit area which supports the roller skate in the heel area correspondingly higher on the roller holder con responding to the higher positioning of the boot area at the heel in comparison to the boot area at the sole.

Further advantageous embodiments of the present invention can consist in embodying the area portions of the roller skate deposit area delimiting the roller receiving slit in a flat, or convexly arched manner parallel with the roller receiving slit. In the latter case, the inline skate can swing into a vertical position after having been stored.

If the device is only equipped with one roller receiving slit, there is the possibility of individually arranging the two devices required for a pair of roller skates in respect to each other in accordance with conditions of space or for display purposes. However, a preferred embodiment consists in providing at least two roller receiving slits laterally spaced apart and parallel with each other in the roller skate deposit area.

In its simplest design, in a lateral view the device is embodied as an inverted U-shape, wherein the at least one roller receiving slit is provided in the connecting strip connecting the U-legs with each other. A further design, particularly suited for display purposes, provides the embodiment of the device as an inverted shell, and to provide the at least one roller receiving slit in the shell bottom part.

Both embodiment variations gain in an esthetic sense, if the U-legs, or respectively the face walls of the shells, extend obliquely downward and outward. In this case the particular advantage of being able to stack devices designed in the same way, as well as an easier unmolding thereof, is achieved in case they are injection-molded of plastic, in particular plexiglass, which is preferred.

In order to make possible the simplest positioning of the boot on the device, it is advantageous if the at least one roller receiving slit at one face end of the device extends essentially over its entire height, so that the roller holder can be pushed into the roller receiver slit from the one face end of the device.

Finally, it is advantageous to equip the device with connecting elements for the mutual releasable connection with further devices designed in the same way. This provides the possibility for putting down incline skates as needed on individual devices, which are arranged next to each other or behind each other and can be fixedly connected with each other.

BRIEF DESCRIPTION OF THE DRAWINGS

Exemplary embodiments of the present invention are represented in the drawings. Shown are in.

DESCRIPTION OF THE PREFERRED EMBODIMENT

Figure 1:
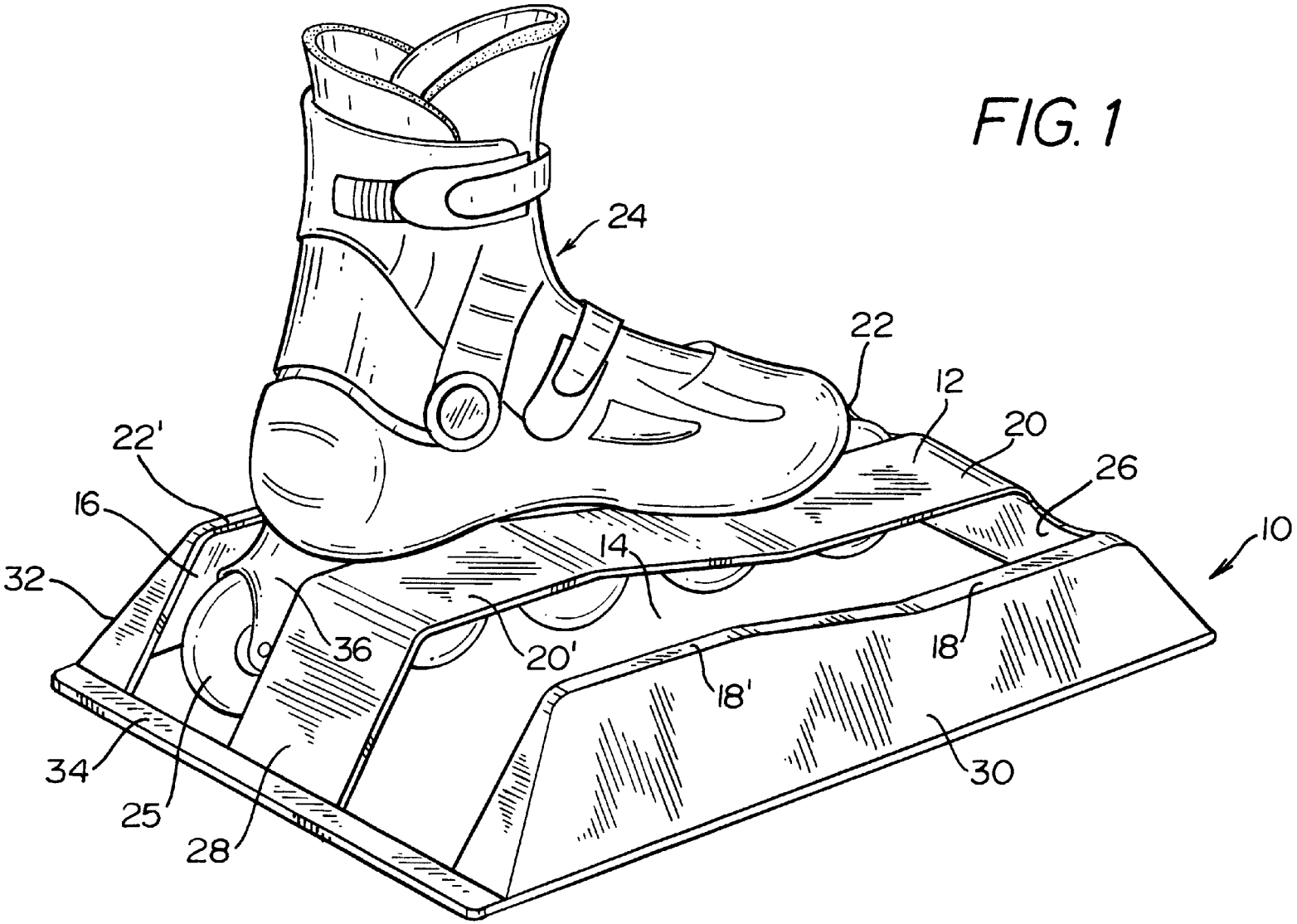
FIG. 1, a graphic representation of a first exemplary embodiment of the device with an inline skate deposited on it, FIG. 2, a lateral view of the device in accordance with FIG. 1 at a reduced scale, FIG. 3, a graphic representation of a second exemplary embodiment of the device, FIG. 4, a lateral view of the device in accordance with FIG. 3 at a reduced scale.
Figure 2:
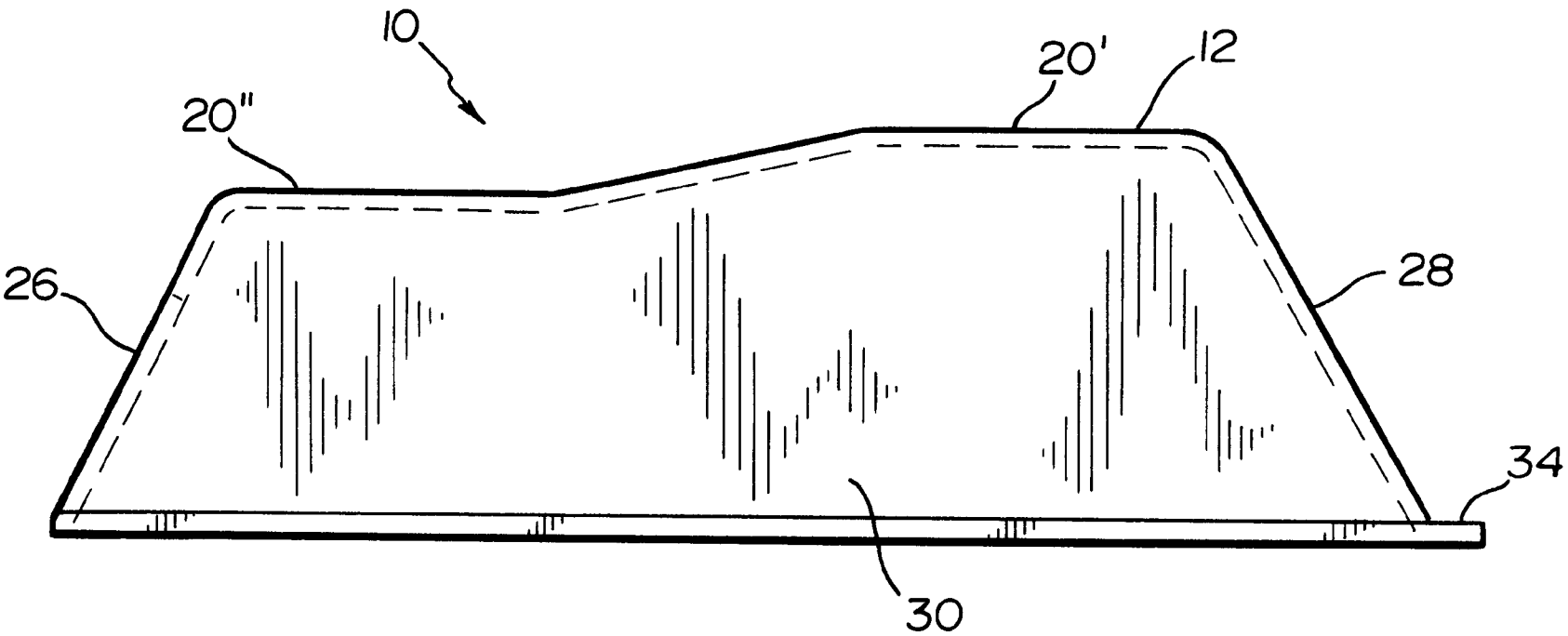
Figure 3:
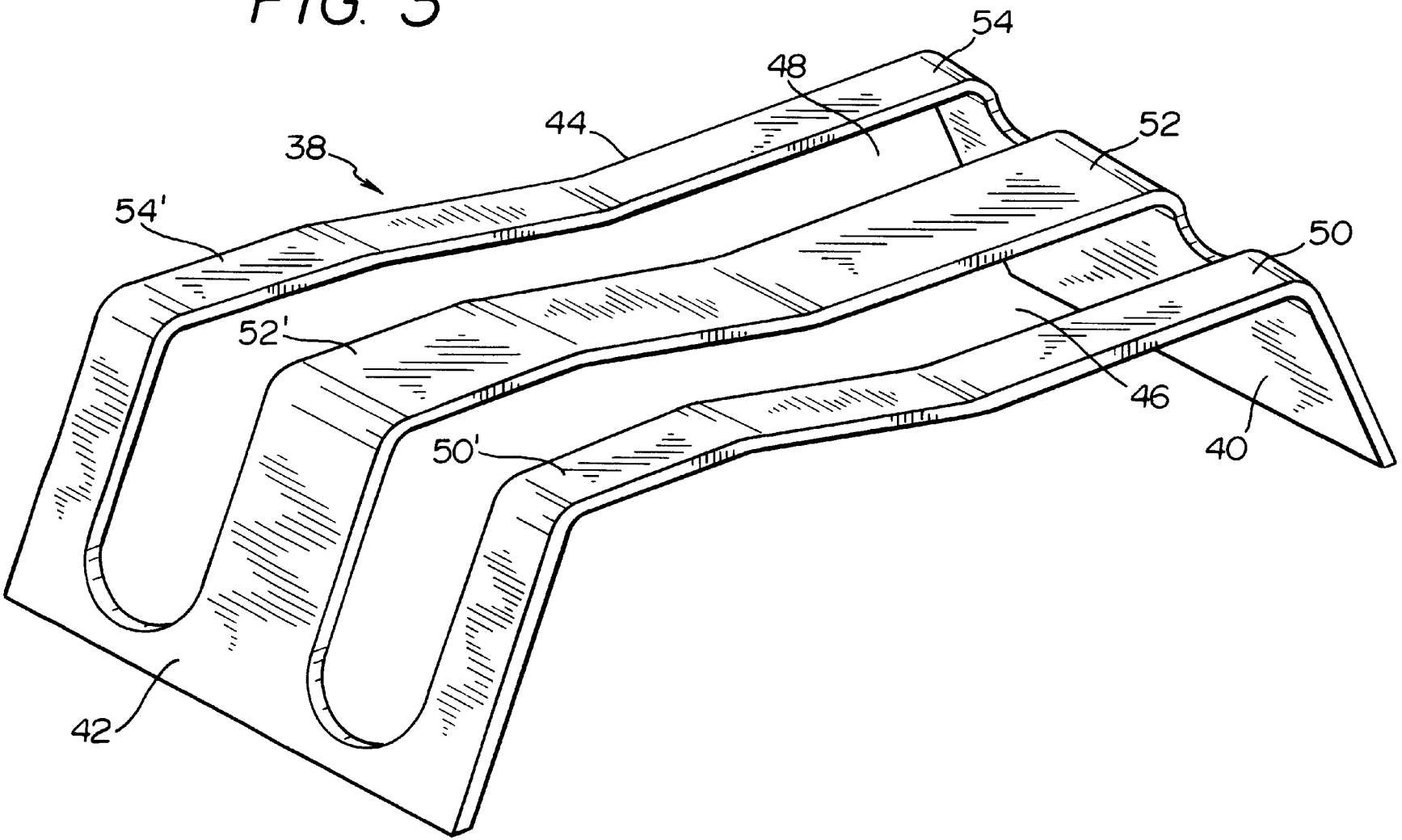
Figure 4:
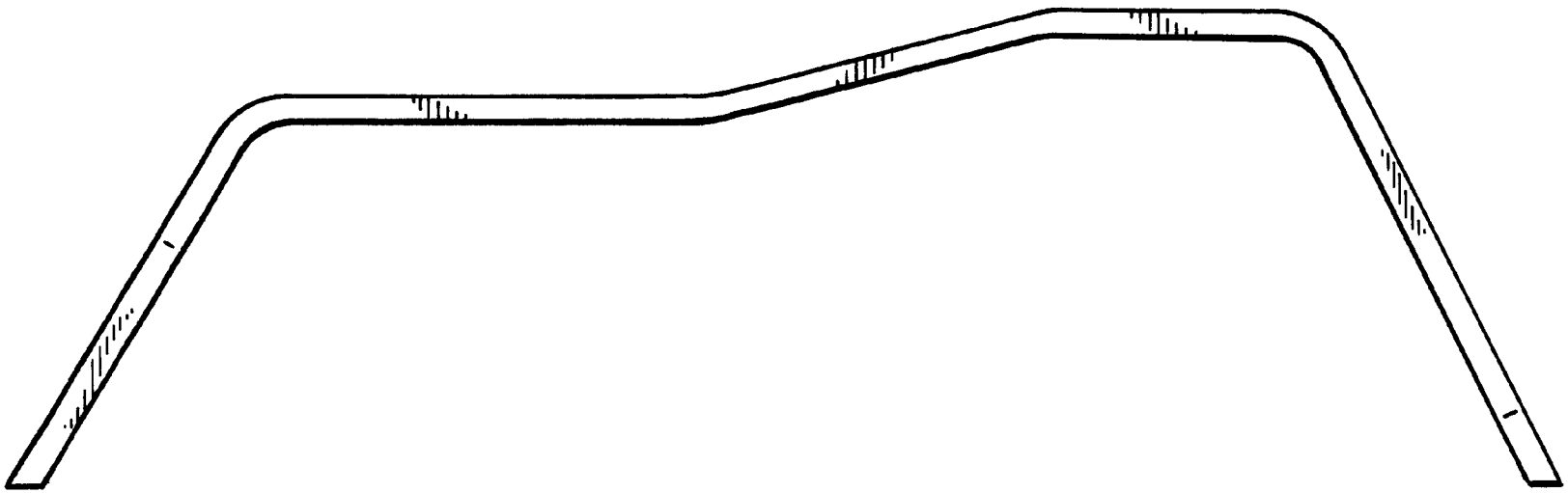

A device constituting a roller skate stand can be seen in FIG. 1, which is indicated as a whole by 10 and has been designed for putting up a pair of roller skates identified as so-called "inline skates".

It is embodied in the form of an inverted shell, wherein two roller receiving slits 14 and 16, which extend parallel at a lateral distance from each other and in the longitudinal direction of the shell, extend through its bottom part 12, which lies on top.

The flat outside of the bottom part 12 constitutes a roller skate deposit area, which is divided into three strip-like area elements 18, 20, 22 by the slit arrangement, of which the center strip element 20 has been kept wide enough so that two roller skates 24 (inline skates) can be deposited on it next to each other.

What is claimed is:

1. A device for storing at least one boot with only one guide track fixed on the sole of the boot, comprising a receiving body having at least one elongated opening and defining an upper deposit area adjacent to said at least one elongated opening, said upper deposit area being configured to engage the sole of a boot to bring the boot into engagement with the respective elongated opening in a freely suspended manner, wherein said upper deposit area is transversely arched, transversely with respect to the longitudinal direction of said receiving slit.

2. A device for storing at least one boot with only one guide track fixed on the sole of the boot, comprising a receiving body having at least one elongated opening and defining an upper deposit area adjacent to said at least one elongated opening, said upper deposit area being configured to engage the sole of a boot to bring the boot into engagement with the respective elongated opening in a freely suspended manner, wherein when viewed laterally said receiving body has the shape of an inverted U comprising two U-legs and a connecting strip, and wherein said at least one elongated opening extends across at least said connecting strip.

3. The device as defined in claim 2, wherein said U-legs extend obliquely downward and outward.

4. A device for storing at least one boot with only one guide track fixed on the sole of the boot, comprising a receiving body having at least one elongated opening and defining an upper deposit area adjacent to said at least one elongated opening, said upper deposit area being configured to engage the sole of a boot to bring the boot into engagement with the respective elongated opening in a freely suspended manner, wherein said receiving body is embodied as an inverted shell defining a bottom surface, and wherein said at least one elongated opening is provided in the shell bottom surface.

5. The device as defined in claim 4, wherein said inverted shell further defines front face walls extending from said bottom surface, and wherein said front face walls extend obliquely downward and outward.

6. The device as defined in claim 5, wherein said receiving slit extends over essentially the entire length of at least one of said front face walls.

7. The device as define in claim 6, wherein said receiving slit extends partially into the other of said front face walls.

8. A device for storing at least one boot with only one guide track fixed on the sole of the boot, comprising a receiving body having at least one elongated opening and defining an upper deposit area adjacent to said at least one elongated opening, said upper deposit area being configured to engage the sole of a boot to bring the boot into engagement with the respective elongated opening in a freely suspended manner, wherein said receiving body is embodied as an inverted shell defining a bottom surface, and wherein said at least one elongated opening is provided in the shell bottom surface.

* * * * *